US007430977B2

(12) United States Patent
Tolbert

(10) Patent No.: US 7,430,977 B2
(45) Date of Patent: Oct. 7, 2008

(54) WATERCRAFT RECOVERY DEVICE

(76) Inventor: John J. Tolbert, 23453 Brook Forest Rd., New Caney, TX (US) 77357

( * ) Notice: Subject to any disclaimer, the term of this patent is extended or adjusted under 35 U.S.C. 154(b) by 0 days.

(21) Appl. No.: 11/559,125

(22) Filed: Nov. 13, 2006

(65) Prior Publication Data

US 2007/0107649 A1 May 17, 2007

Related U.S. Application Data

(60) Provisional application No. 60/736,965, filed on Nov. 15, 2005.

(51) Int. Cl.
*B63B 21/22* (2006.01)
*B63H 25/02* (2006.01)

(52) U.S. Cl. ..... 114/210; 114/144 A

(58) Field of Classification Search ..... 114/144 A, 114/294, 210, 230.2, 230.25; 440/62, 63
See application file for complete search history.

(56) References Cited

U.S. PATENT DOCUMENTS 3,980,039 A * 9/1976 Henning ..... 440/6
4,248,171 A 2/1981 Barbour
4,531,470 A * 7/1985 Paul ..... 114/230.26
4,614,900 A * 9/1986 Young ..... 318/16
4,824,408 A * 4/1989 Aertker et al. ..... 440/6
5,832,440 A 11/1998 Woodbridge et al.
5,957,075 A * 9/1999 Byrne et al. ..... 114/230.2
6,776,671 B2 8/2004 Dunn
6,843,196 B1 1/2005 Richardson et al.
6,880,479 B2 4/2005 Low
6,895,884 B1 5/2005 Velazquez

* cited by examiner

*Primary Examiner*—Sherman Basinger
(74) *Attorney, Agent, or Firm*—Buskop Law Group, PC; Wendy Buskop

(57) ABSTRACT

The present embodiments of the invention generally relate to a watercraft recovery device and method. The watercraft recovery method provides for operatively releasing an anchor from a watercraft, starting the watercraft, and steering the watercraft. The watercraft recovery device allows fisherman or other users to wade away from the boat and to recover the watercraft without re-navigating the water to return to the watercraft. This will help to ensure that fisherman or other users can quickly recover their boat in the case of an unexpected storm that makes the water conditions unsafe.

13 Claims, 7 Drawing Sheets

WATERCRAFT RECOVERY DEVICE

CROSS-REFERENCE

This non-provisional patent application claims benefit to copending Provisional Patent Application 60/736,965, which was filed Nov. 15, 2005. The Provisional Patent Application No. 60/736,965 is incorporated by reference herein.

FIELD

The present embodiments relate generally to an anchor release device, watercraft recovery device, and a method for providing a remote control watercraft.

BACKGROUND

There has existed a need for a device and method for remotely recovering a watercraft. Recreational use requires people to leave their watercraft anchored in water while exploring by foot or fishing. People often end up a great distance from the watercraft and need to recover the water craft quickly.

The present embodiments of the invention meet these needs.

BRIEF DESCRIPTION OF THE DRAWINGS

The detailed description will be better understood in conjunction with the accompanying drawings as follows.

Figure 1:
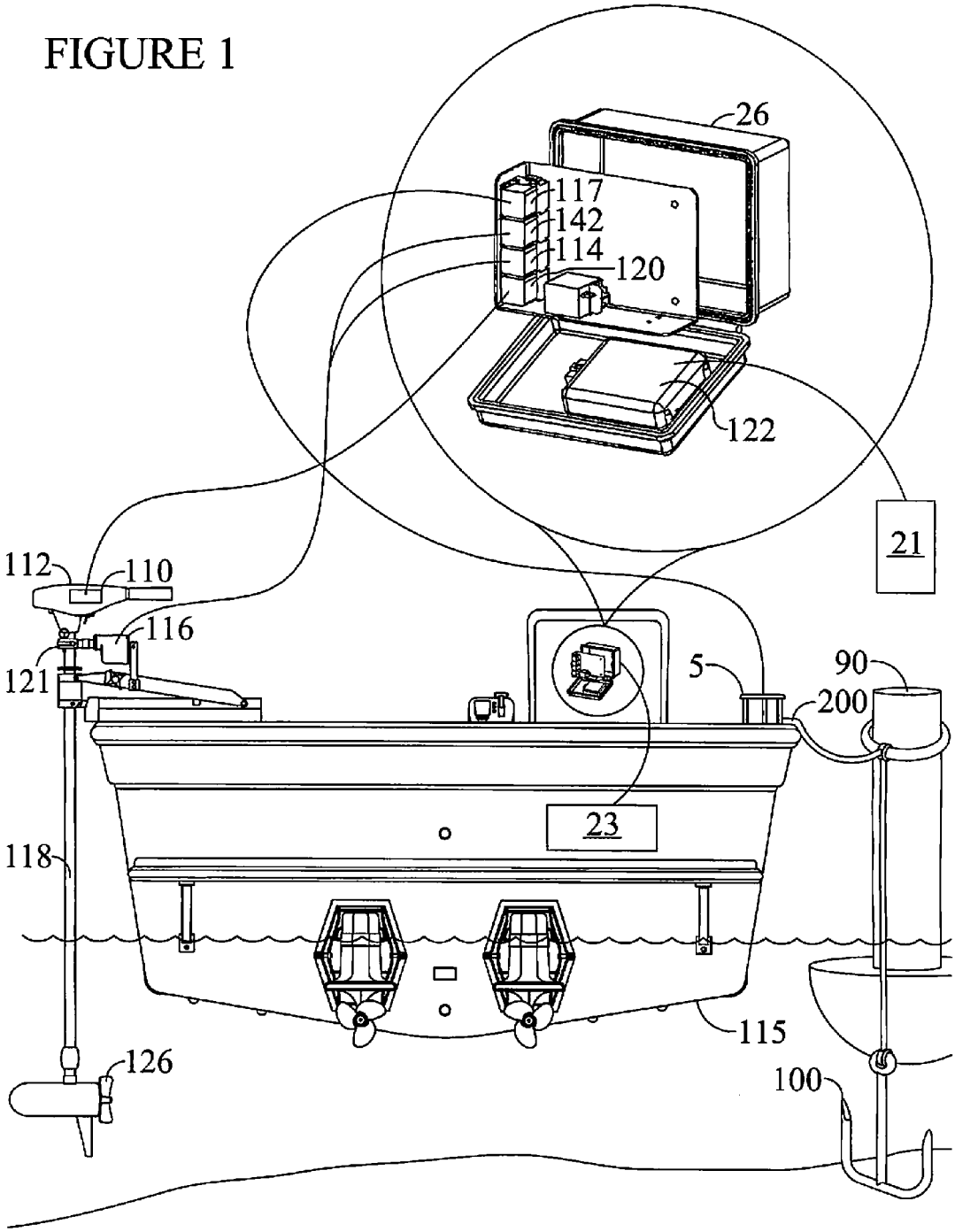
FIG. 1 depicts a an embodiment of the water craft recovery device.

The present embodiments are detailed below with reference to the listed Figures.

DETAILED DESCRIPTION OF THE EMBODIMENTS

Before explaining the present embodiments in detail, it is to be understood that the invention is not limited to the particular embodiments and that the invention can be practiced or carried out in various ways.

The present embodiments of the invention generally relate to a watercraft recovery device and method. The watercraft recovery method provides for operatively releasing an anchor from a watercraft, starting the watercraft, and steering the watercraft.

The watercraft recovery device allows fishermen or other users to wade away from the boat and to recover the watercraft without re-navigating the water to return to the watercraft. This will help to ensure that fishermen or other users can quickly recover their boats in the case of unexpected storm that makes the water conditions unsafe.

The watercraft recovery device can also be used if the fisherman or other user experiences a medical emergency and needs to recover the watercraft quickly.

An embodiment of a watercraft recovery device can be used to remotely start a trolling motor on a boat, steer the boat with the trolling motor, and release an anchor rope operatively connected to a spring loaded anchor release device. The anchor rope can be equipped with a float for recovery after the operator returns to the anchor rope drop site.

The anchor rope can be attached to an anchoring weight at one end and can be looped at an opposite end. The float can be located on the anchoring rope where the loop is created.

An embodiment of the watercraft recovery device can include a spring loaded anchor release device. The anchor release device can be made from a non-corrosive material, such as: a steel, a stainless steel, a cast steel, a brass, a cast brass, an aluminum, a cast aluminum, a plastic, or a similar material, and combinations thereof. The anchor release device can include a top housing which operatively slides over a bottom housing. The top housing can contain a centrally positioned anchor rope pin for releasably holding the looped portion of the anchor rope. The anchor rope pin can further include a trip spring surrounding the anchor rope pin. The anchor release device can further include at least four threadable guide pins, which operatively secure the top housing to the bottom housing.

In a non-limiting embodiment of the anchoring device, the threadable guide pins are threaded at one end and permanently attached to the top housing at the other end.

In addition, the bottom housing can include a trip spring housing with an anchor rope pin seat, which receives the anchor rope pin. A plate can be secured to the spring housing for receiving the at least four exterior guide pins and fasteners to engage a watercraft deck.

A anchor rope insertion cavity can be formed into the bottom housing. The anchor rope insertion cavity can be aligned so that the looped portion of the anchor rope can be inserted into the cavity.

A latch assembly can be mounted to the bottom plate. The latch assembly can include a latch bar, secured to at least two exterior guide pins and a trip-latch hinge finger, hingedly connected to the bottom plate and adapted to removably engage the latch bar.

The trip-latch hinge finger can be adapted to engage the latch bar by being centrally keyed to lock with the latch bar. A latch spring can be positioned in the bottom plate. The position of the latch spring can be such that it is centrally aligned to engage the terminal end of the trip-latch hinge finger opposite the latch bar. When the top housing is in a second position, this arrangement causes the trip-latch hinge finger to align with the latch bar.

The bottom of the trip-latch hinge finger can be operatively aligned with a solenoid. The solenoid should be aligned so that when it is activated, it will strike the bottom of the trip-latch hinge finger, causing the latch bar to release, allowing the trip spring to move the anchor rope pin away from the anchor rope pin seat. The solenoid can be further connected to a power supply, which can be remotely activated allowing the solenoid to be energized.

An embodiment of the watercraft recovery device can further include a receiver disposed within a control box, adapted for receiving a signal to energize the solenoid to strike the trip-latch hinge finger.

An alternative, non-limiting embodiment of the watercraft recovery device can also include a remote transmitter for transmitting the signal to the receiver for energizing the solenoid.

An alternative embodiment of the watercraft recovery device can further include a linear actuating device, operatively coupled to a trolling motor. The linear actuating device can be remotely operated by the activation of relays which are wired to the actuating device. The relays can be operatively mounted within the control box. Specifically, one relay will cause the actuator to push on the steering shaft of the trolling motor disposed between the motor propeller and the control handle, causing the device to turn the steering shaft in one direction, while a second relay when activated will cause the linear actuating device to pull on the steering shaft causing the steering shaft to turn the other direction. A third relay can be used to start the trolling motor. The relays can be electrical relays commonly known in the art, such as those sold by Bosch.

The relays are operatively connected to the power source, and when activated allow power to be sent to what they are connected to. For example, the relays connected to the linear actuator energize the actuator when they are activated.

In another embodiment a by-pass switch can be activated which will allow the trolling motor to be started without the use of a relay, i.e, the trolling motor can be started manually.

In an embodiment of the watercraft recovery device, an anchor mechanism can have a weight ranging from 1 pound to 2000 pounds operatively connected at one end of an anchor rope.

An embodiment of the watercraft recovery device can further include a programmable kill-switch which can be disposed within the control box and wired to the motor ignition system to cause the motor to shut down after a specified time or by the sending of a signal from the transmitter to the receiver located in the control box.

An alternative embodiment of the anchor release device can further include a latch assembly mounted to a bottom side of the bottom plate. The latch assembly can include a latch bar secured to two of the at least four guide pins. The trip-latch hinge finger can be adapted to removably engage the latch bar. A solenoid can be aligned with the trip-latch hinge finger, so that when activated, the solenoid strikes the trip-latch hinge finger and releases the latch bar, enabling the trip spring to move the anchor rope pin away from the anchor rope pin seat. The solenoid can be further connected to a relay disposed within a control box. A receiver can be disposed within the control box. The receiver can be adapted for receiving a signal to energize the solenoid to strike, causing it to strike the trip-latch hinge finger. A remote transmitter can be used for transmitting the signal to the receiver for energizing the solenoid.

The watercraft recovery device relates to a method for providing a remote-controlled, watercraft having the acts of mounting a watercraft recovery device to an object, wherein the watercraft recovery device can include an anchor release device.

The anchor release device can include a top plate connected to a top housing. The top housing can include an anchor rope pin disposed in the top housing and a trip spring surrounding the anchor rope pin. The top plate can include at least four guide pins mounted to the top plate.

The guide pins can connect the top plate to a bottom plate. The bottom plate can include a bottom housing for slidably engaging the top housing and at least one mounting means, such as a bracket to be welded to a watercraft or a bracket to be threadably attached to a watercraft, attached to a bottom side of the bottom plate. The bottom housing can include an anchor rope pin seat adapted for receiving the anchor rope pin. The bottom plate can have at least four extrusions aligned to receive the guide pins. A latch assembly can be mounted to the bottom side of the bottom plate.

The latch assembly can include a latch bar secured to at least two guide pins. A trip-latch hinge finger can be adapted to removably engage the latch bar. A solenoid can be aligned with the trip-latch hinge finger for striking the trip-latch hinge finger and releasing the latch bar, enabling the trip spring to move the top housing away from the bottom plate. A power source can be adapted to provide power to the solenoid.

A receiver can be adapted for receiving a signal transmitted from a remote transmitter to energize the solenoid to strike the trip-latch hinge finger.

An embodiment of the trip-latch hinge finger can also include a remote transmitter for transmitting a signal to the receiver for energizing the solenoid.

An embodiment of the method can also include the act of connecting a rope to an anchoring device. The rope can include a first end with a closed loop and a second end connected to an anchoring mechanism. The rope can connect to the anchor release device by using the closed loop.

The top plate can be moved towards the bottom plate, forcing the spring to be in a compressed state. This can cause the anchor rope pin to secure the looped first end of the rope, causing the anchor rope to be retained.

An embodiment of the method can further include anchoring an object for a period of time. An embodiment of the method can also include using a remote transmitter after completion of the period of time, such as the time it takes a user to explore the wilderness, or the time it takes a fisherman to fish away from the watercraft. The remote transmitter provides a signal to the receiver to energize the solenoid. The remote transmitter can be carried on the user, such as within a pocket or a watertight bag An embodiment of the method can further include the act of striking the trip-latch hinge finger with the energized solenoid to cause the trip-latch hinge finger to disengage the latch bar, enabling the trip spring to move the top housing away from the bottom plate to disengage the anchor rope pin from the anchor rope pin seat and release the looped end of the rope.

An embodiment of the method can include the act of starting the motor by using a transmitter to send a signal to the receiver for activating a motor start relay.

Another embodiment of the method can include steering the watercraft by performing the act of activating a plurality of relays connected to a linear actuator, which can be connected to the watercraft motor shaft, by using the transmitter to send a signal to the receiver.

An embodiment of the method can further include the action of boarding the watercraft when it reaches a desired location.

Yet another embodiment of the method can include directing the watercraft to port. The watercraft can be directed to port by using the transmitter to send signals to the receiver for activating the plurality of relays connected to the linear actuator, or by manually steering the watercraft.

The linear actuator can have an incremental step distance which can be adjusted to meet any requirement. For example, the linear actuator can be adjusted to have a step function ranging from 0 degrees to 40 degrees.

The relays can be the type commonly know in the art. For example they can be relays purchased from Bosch. The linear actuator can be of a type commonly known in the art, such as linear operators manufactured by Bosch.

The shaft collar can be of a type commonly known in the art. The shaft collar should have a threaded opening sized to receive a collar key. When the collar key is inserted into the threaded hole in the collar, the collar key can be used to increase the friction force between the collar and the motor shaft.

The solenoid can be a type used by GMC™ for electric door locks, or other solenoids common in the art.

The remote transmitter can be a Directed Electronic three-channel receiver and transmitter; a two-way remote-control transmitter and receiver, such as a Two-Way Alert Model #5501R/LDC remote transmitter and receiver; or a similar electronic transmitter and receiver. The remote transmitter can be stored in a dry-pack, water-tight sealed, plastic bag. The receiver can be integrated with the watercraft recovery device by electric wiring and located in a casing, which can be disposed on the watercraft in a covenant place. The case should be a water-tight case, such as the case made by Pelican, catalog number 1120.

The remote transmitter can send a signal to the receiver to activate any one of the relays. The signal range can be up to 2,500 feet.

Certain embodiments of the method include mounting the anchoring device to an object, such as: a floating vessel, a floating recreational vessel, a waterborne craft, a similar movable object, and combinations thereof.

In one embodiment of the method, the anchoring device includes one rope connected to one object. Other embodiments of the method can include two or more ropes, retained by the anchoring device and connected to two or more objects.

An example of an embodiment of the method can include mounting a watercraft recovery device to a watercraft. The mounting can be accomplished by welding the device to the watercraft, threadably connecting the watercraft recovery device to the watercraft, or using other similar means for mounting. The anchor release device can be similar to the ones described herein and in the figures.

The next act in the example would include connecting a rope to the anchoring device. The rope comprises a first end with a loop. The loop can be prefabricated or created by looping the terminal end and tying the terminal end of the rope to a segment of the rope dependent on the size of the loop required. The segment of the rope can be a spot located a distance from the terminal end in a direction toward a second end. A second end can be connected to an anchoring mechanism, such as a hook anchor, a shovel anchor, or another object having a weight significant enough to keep the watercraft from moving. The rope connects to the anchor release device by using the looped end.

The next action in the example can include moving the top plate toward the bottom plate, forcing the trip spring to be in a compressed state, causing the anchor rope pin to engage the anchor rope pin seat, causing the anchor rope pin to secure the looped first end of the rope for retaining the rope. The anchor rope pin secures the looped end of the rope by being disposed within the loop.

The example can include anchoring the watercraft for a period of time. The period of time can be the time a fisherman needs to properly fish an area, or the time a user needs to explore an area outside of the watercraft.

The next action in the example can further include using a remote transmitter, after completion of the period of time, to provide a signal to the receiver. The receiver will energize the solenoid by activating a relay, allowing a power to be supplied to the solenoid.

In the example, once the solenoid is energized, the action that could follow could be the energized solenoid striking the trip-latch hinge finger. When the trip-latch hinge finger is struck, it will disengage the latch bar, enabling the trip spring to move the top housing away from the bottom plate, causing the anchor rope pin to disengage the anchor rope pin seat and release the looped end of the rope.

Another action in the example can include starting the motor by sending a signal from the transmitter, activating a motor start relay. A next action can include steering the watercraft by using a transmitter to activate a plurality of relays connected to a linear actuator which is connected to the motor of a watercraft. For example, one relay can be a push relay which will cause the linear actuator to incrementally create a pushing force on the motor shaft, which will cause the watercraft to turn in a first direction, while another relay can be a pull relay which will cause the linear actuator to create an incremental pulling force in the motor shaft, causing the watercraft to turn in a second direction. Once the watercraft reaches a desired location, the next action in the example can include boarding the watercraft. The next action can include directing the watercraft to port.

The remote transmitter can be a member selected from the group consisting of: a Directed Electronic three-channel receiver and transmitter, a two-way alert remote-control transmitter and receiver, other electronic transmitter and receiver, and combinations thereof.

Figure 2:
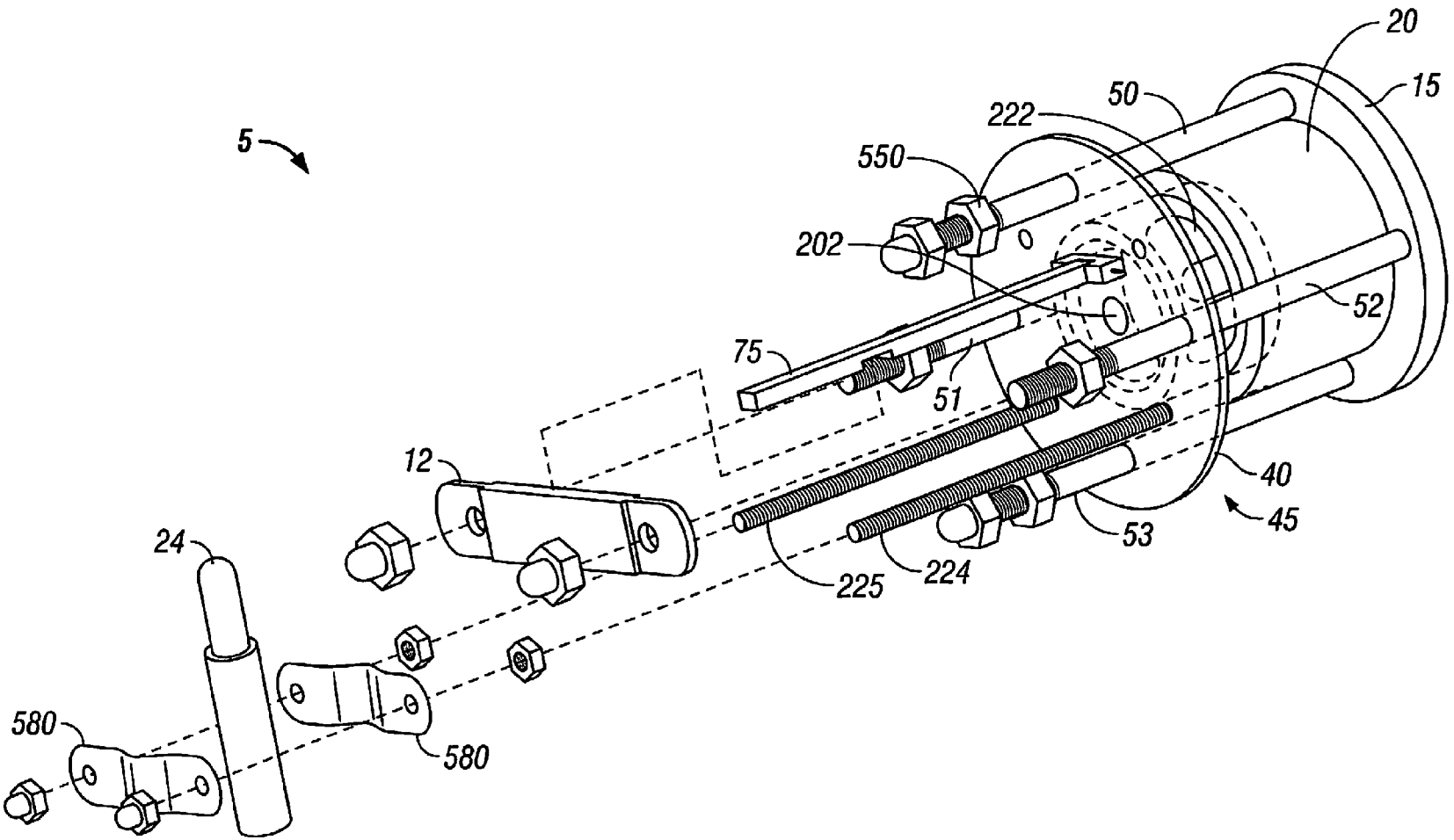
FIG. 2 depicts a view of a partial exploded embodiment of the anchor release device.

FIG. 1 depicts a view of a non-limiting embodiment of the watercraft recovery device mounted to a watercraft and using one rope connected to an anchoring object 100. The embodiment includes a spring loaded anchor release device 5 that can be mounted to the watercraft 115. The spring loaded anchor release device 5 has a solenoid 24 wired to an activation relay 117 disposed within the control box 26, as depicted in FIG. 2. The control box can be rated for at least one volt. The relay is also connected to a power source 23, which can be more than one volt. When a remote transmitter 21, which can be a 24-volt transmitter, is used to activate the spring loaded anchor release device 5, a receiver 122, located within the control box 26 activates the activation relay 117, which allows the power source 23 to energize the solenoid 24 which strikes a trip-latch hinge finger 75, allowing the top housing 20 (depicted in FIG. 7 and FIG. 2) to return to a first position. An anchor rope 200 is secured to an anchor device 100. A float 90 is attached to the anchor rope 200.

The relays disposed within the control box 26 are operatively wired to the receiver 122 and power source 23. The solenoid 6 can be a solenoid, such as a push type tubular solenoid model S-20-100-H, sold by Magnetic Sensor Systems, of 6901 Woodley Avenue, Van Nuys, Calif. 91406.

After the spring loaded anchor release device 5 has released the anchor mechanism 100, the watercraft 115 is free to move.

In an embodiment of the watercraft recovery device, the watercraft can be controlled by using the remote transmitter 21 and the receiver 122 to activate a motor start relay 120, which is located inside the control box 26 and wired to the motor ignition system 110. Once the motor 112 is started, the remote transmitter 21 can be used to have the receiver 122 activate the push relay 142 and pull relay 114 disposed within the control box 26. The push relay 142 and pull relay 114 are wired to a linear actuator 116 which is mounted to the steering shaft 118 of the motor 112. When the push relay 142 is activated it will cause the linear actuator 116 to extend forward an incremental step distance producing a pushing force on the collar 121 around the steering shaft 118 creating a moment on the steering shaft 118 which will cause the steering shaft 118 to turn in the direction of the moment.

If the pull relay 114 is activated it will cause the linear actuator 116 to move backwards an incremental step distance, producing a pulling motion on the steering shaft 118, creating a second moment in the opposite direction causing the steering shaft 118 to turn in the direction of the second moment. The interaction between the linear actuator 116 and the steeling shaft 118 allows the watercraft to be steered to the desired location using a remote transmitter.

FIG. 2 is a depiction of an embodiment of the anchor release device 5. The anchor release device 5 includes at least four guide posts 52, 53, 50, 51. It further includes a top housing 20 and a bottom housing 45. The bottom housing 45 is shown as a tubular member to contain the trip spring 10, which is not shown in FIG. 2 but is depicted in FIG. 7.

The bottom housing 45 is secured to the top side 47 (not shown in FIG. 2, but depicted in FIG. 6) of the bottom plate 40. The bottom housing 45 has a centrally located anchor rope insertion cavity 222. The centrally located anchor rope insertion cavity 222 is operatively disposed through the bottom housing 45 below the area 57 (depicted in FIG. 6) where the trip spring 10 is contained in the bottom housing 45 and the top of the plate 40.

The at least four guide posts 50, 51, 52, 53, are secured to a top plate 15 and slidably disposed into extrusions 102, 104, 1O6, 108 (depicted in FIG. 6) in the bottom plate 40. The guide posts 50, 51, 52, 53 allow the top housing 20 to slidably engage the bottom housing 45, as the top plate 15 is moved toward the bottom plate 40, putting the trip spring 10 in a compressed state, shown in FIG. 7.

Figure 6:
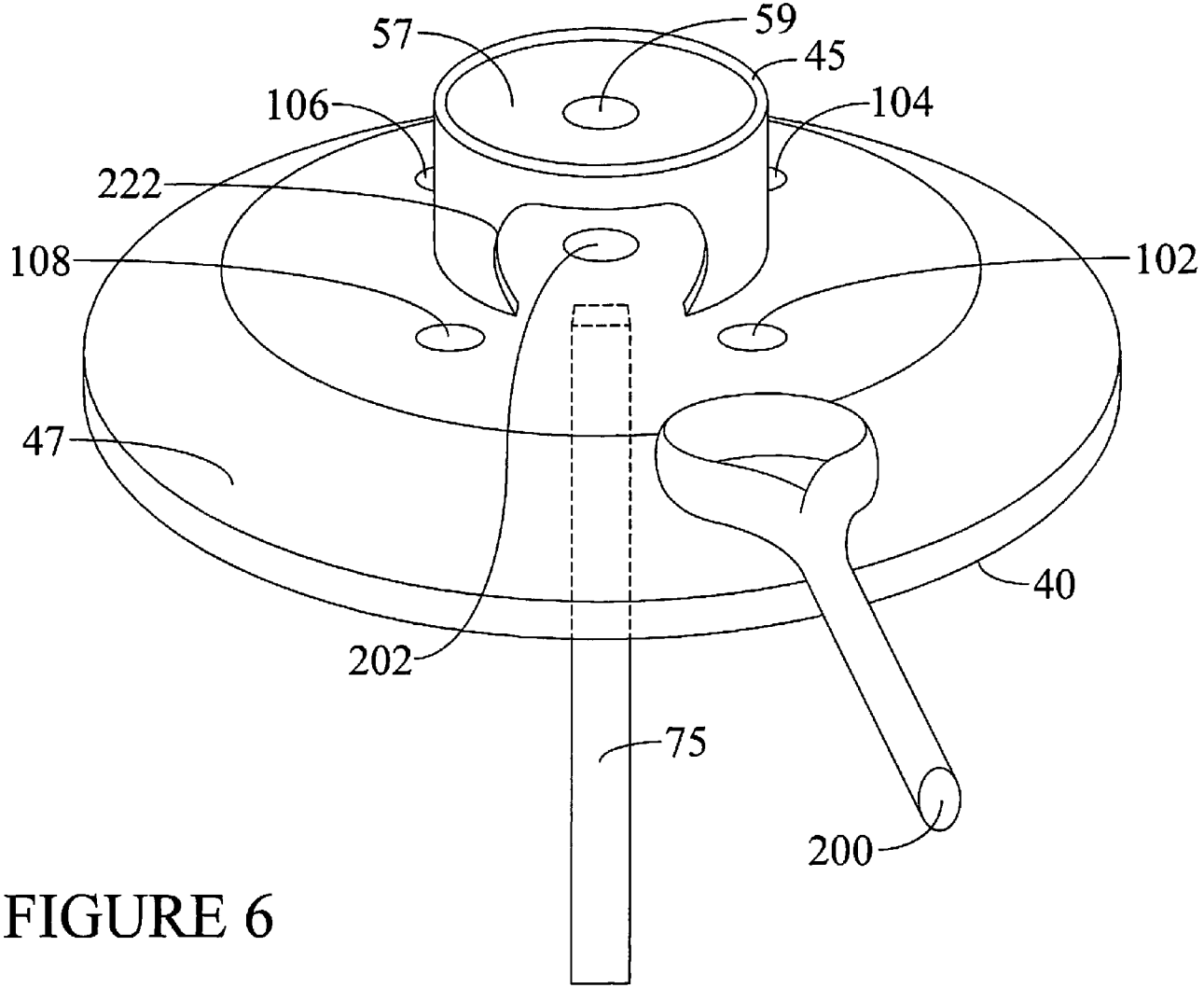
FIG. 6 depicts an embodiment of a bottom plate, with a bottom housing and trip-latch hinge finger.
Figure 7:
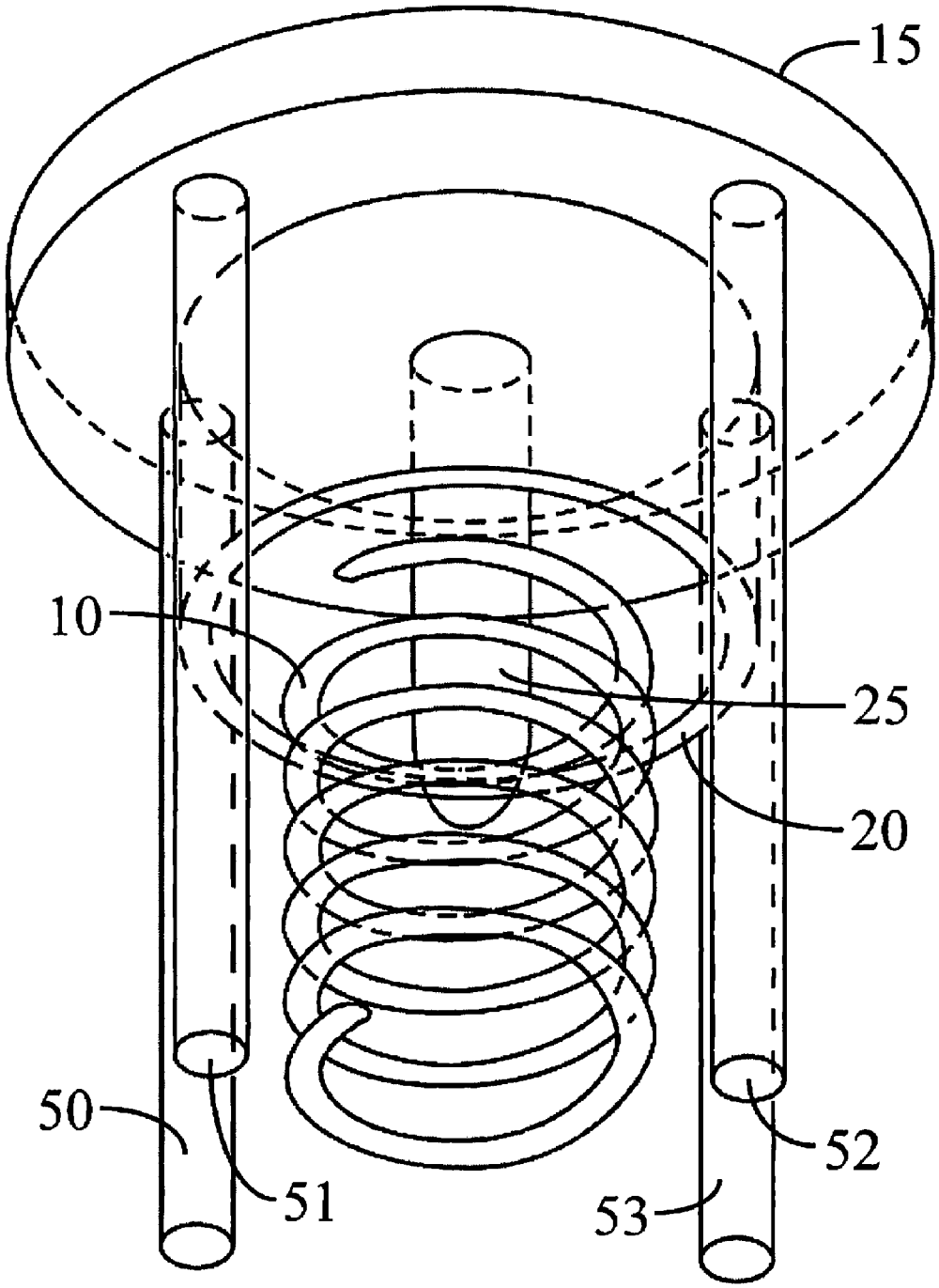
FIG. 7 depicts an embodiment of a top plate with a top housing.

The top housing 20 is adapted to removably contain an trip spring 10, not shown in FIG. 2, but best depicted in FIG. 7. The trip spring 10 surrounds an anchor rope pin 25 (also depicted in FIG. 7), which operatively engages a looped end of the anchor rope 200 (depicted best in FIG. 6), when the top housing 20 is in a second position. When the top housing 20, is slidably engaging the bottom housing 45, the top housing 20 will not block the centrally located anchor rope insertion cavity 222.

The bottom housing 45 is adapted to removably contain the trip spring 10. Additionally, the bottom housing 45 has an anchor rope pin seat 202 formed into the top side 47 of the bottom plate 40. The looped end of the anchor rope 200 is inserted into the anchor rope insertion cavity 222 when the top housing 20 is in a first position.

A trip-latch hinge finger 75 is hingedly connected to the bottom plate 40 so that when the top housing 20 is in a second position, the trip-latch hinge finger 75 will lockedly engage a latch bar 12. The latch bar 12 is operatively removably connected to guide posts 52, 51. A solenoid 24 is mounted to at least two mount pins 224, 225 by the use of bracket 580. The mount pins 224 and 225 are inserted through two extrusions in the bottom plate 40, such that they are operatively aligned with the trip-latch hinge finger 75.

The bottom housing 45 is adapted to receive the trip spring 10 and the anchor rope pin 25, seen in FIG. 7. A cavity disposed between the trip spring 10 and the anchor rope pin seat 202 allows the anchor rope pin 25 to engage the anchor rope pin seat 202 when the top housing 20 is in a second position. Each exterior guide pin comprises a mechanical stop 550 for controlling a distance of movement between the anchor release device and the bottom plate.

Figure 3:
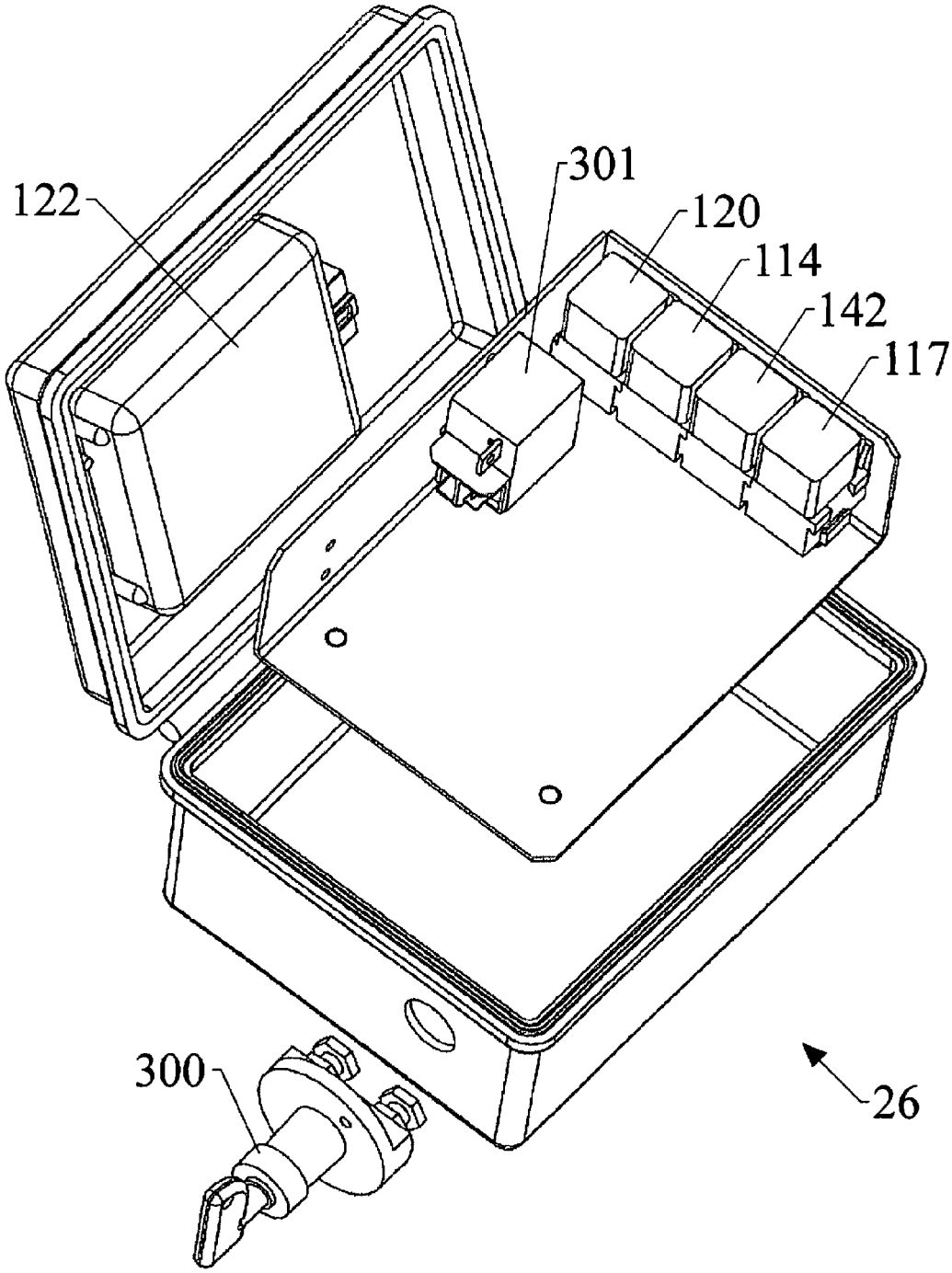
FIG. 3 depicts an embodiment of the control box.

FIG. 3 is an embodiment of the control box 26. The control box 26 is shown to contain a receiver 122; a start relay 120, a pull relay 114, a push relay 142, and a activation relay 117. Additionally, the control box contains a by-pass 300, which allows the motor to be started manually, and a power step up relay 301, which can be used to increase the power supplied to a motor. The relays should be rated for handling at least one volt.

Figure 4:
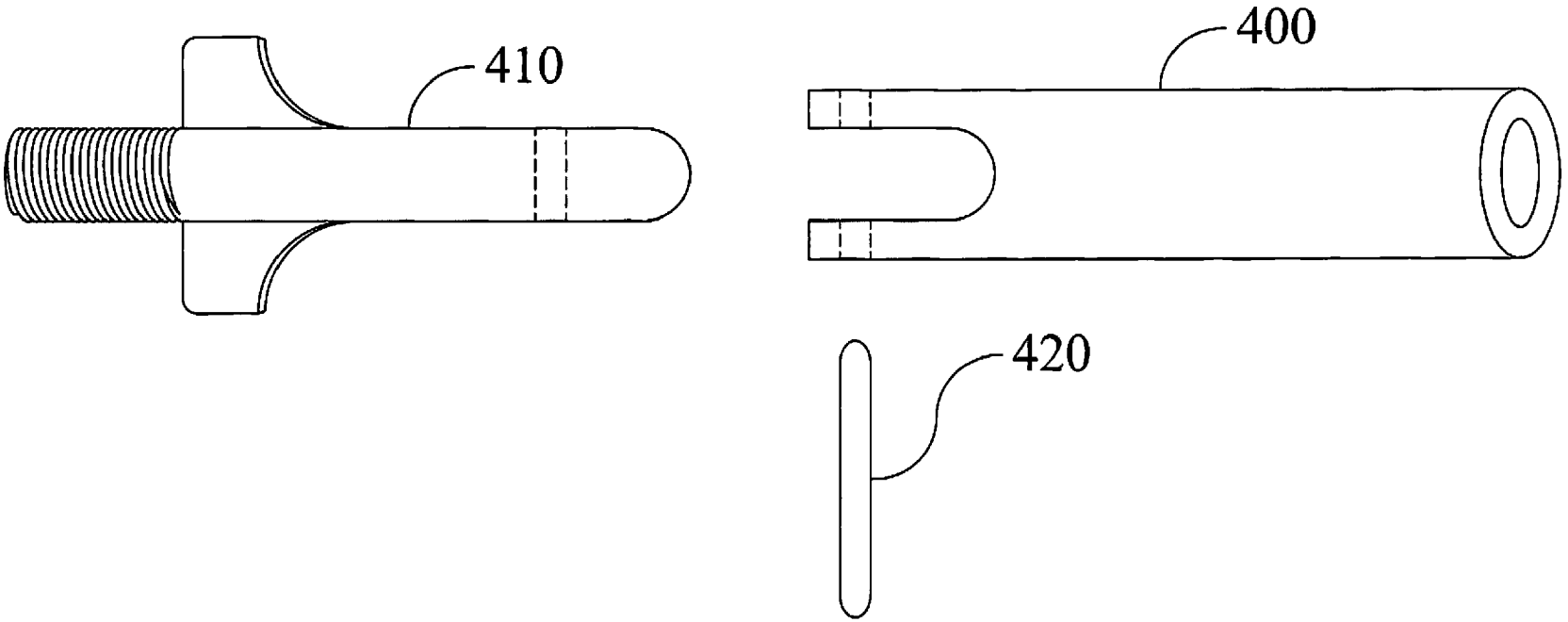
FIG. 4 depicts an embodiment of the linear actuator extension and collar key.

FIG. 4 depicts linear actuator extension 400 and collar key 410. The collar key 410 is adapted to operatively tighten a collar 121, not shown in FIG. 4 but best depicted in FIG. 5, removably connected to a steering shaft 118 (depicted in FIG. 5). The collar key threadably attaches to a threaded cavity, not shown, in the collar 121 so that it is offset from the central axis of the steering shaft. The collar key is hingedly connected to the linear actuator extension 400. The linear actuator extension 400 is operatively connected to the linear actuator 116 (shown in FIG. 5). Pin 420 is used, such as a cotter pin, to pinedly connect the collar key 410 to the linear actuator extension 400, best depicted in FIG. 4.

In an embodiment of the linear actuator extension 400, a groove can be formed into the top side and bottom side allowing for a padding to be applied to the linear actuator extension 400.

Figure 5:
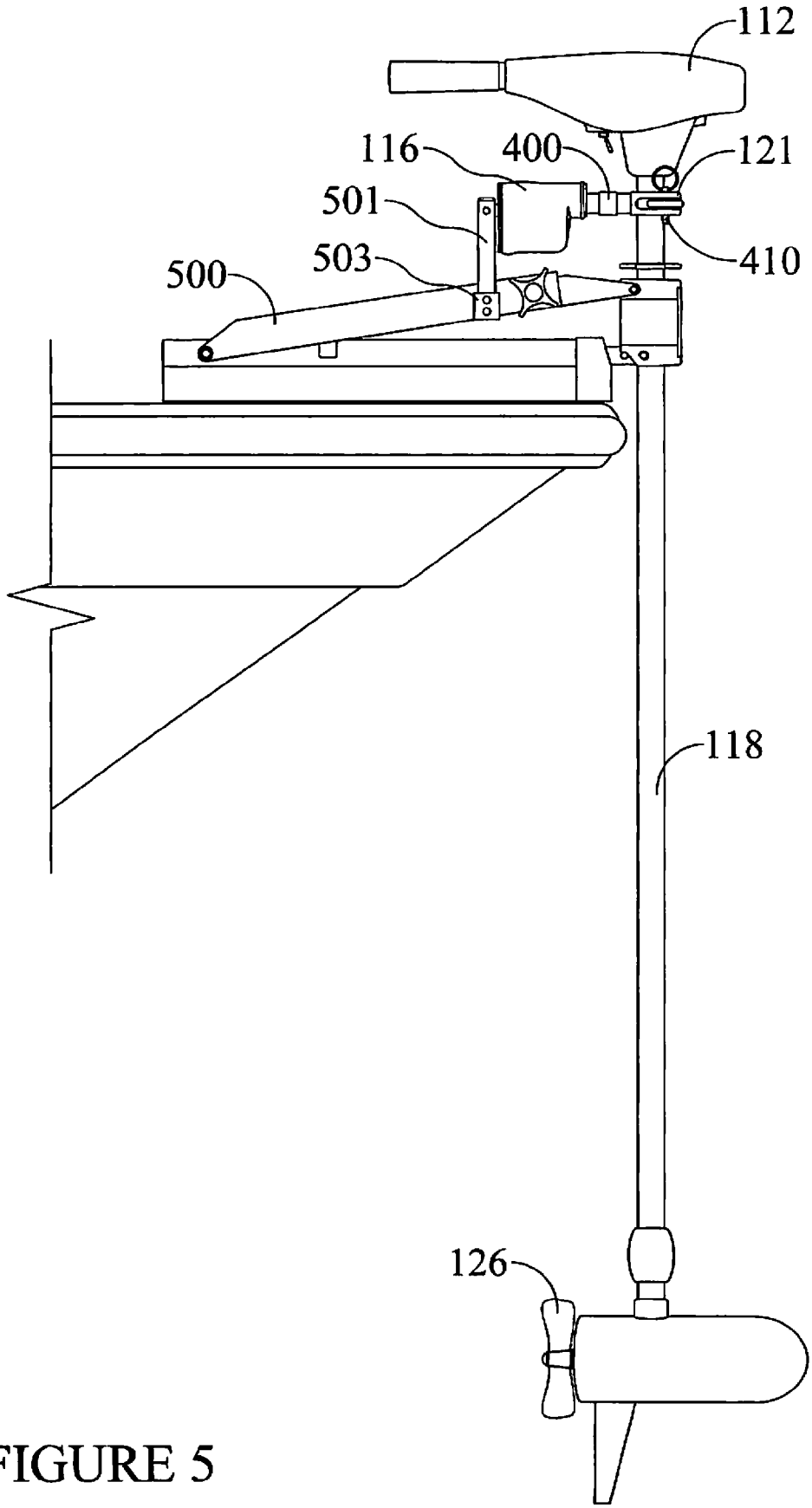
FIG. 5 depicts an embodiment of the linear actuator connected to a trolling motor.

FIG. 5 is the linear actuator 116 attached to steering shaft 118. The steering shaft 118 operatively connects the propeller 126 to the trolling motor 112. When the steering shaft 118 is rotated, it causes the motor 112 to turn in the direction of rotation. The linear actuator 116 is depicted connected to the extension 400 which is shown operatively connected to the steering shaft 118, by the selective use of a collar 121 and the collar key 410. The linear actuator 116 is fixedly attached by a bracket shaft 501 inserted into a receptacle 503 in a motor mount 500.

FIG. 6 depicts a view of an embodiment of a base and a trip-latch hinge finger usable in an anchoring system. The base includes a bottom plate 40 connected to a bottom housing 45 for slidably engaging the top housing 20 (not shown in FIG. 6 but depicted in FIG. 7). A latch assembly can be mounted through the bottom plate 40, which includes a trip-latch hinge finger 75 that can be grooved for retaining the latch bar 12 (depicted in FIG. 2) to enable the securing assembly and trip spring 10 (depicted in FIG. 7) to remain in a compressed position. The trip-latch hinge finger 75 can move away from the latch bar 12, which in turn enables the securing assembly to move away from the base. The bottom housing 45, contains a spring housing area 57 adapted to contain the trip spring 10. The spring housing areas 57 can surround an anchor pin bushing 59 for allowing the anchor pin to engage the anchor rope pin seat 202.

FIG. 7 depicts a view of an embodiment of the top plate and top housing of an embodiment of the anchor release device. The embodiment includes a top plate 15 connected to a top housing 20. The top housing 20 includes an anchor rope pin 25 disposed in the top housing 20 with a tapered end adapted for engaging the anchor rope pin seat 202 (depicted in FIG. 6) located in the base. The trip spring 10 surrounds anchor rope pin 25. The embodiment includes a top plate 15 with four exterior guide pins 50, 51, 52, and 53 mounted to the top plate 15 for connecting the securing assembly to the base.

While these embodiments have been described with emphasis, it can be understood that within the scope of the appended claims, the embodiments might be practiced other than as specifically described herein.

What is claimed is:

1. An anchoring device for remotely starting a trolling motor on a boat, steering the boat with the trolling motor, and dropping an anchor connected to a rope comprising:

a spring loaded anchor release device comprising: a top housing for sliding over a bottom housing, wherein the top housing contains a centrally positioned anchor rope pin for releasably holding an anchor rope, a spring surrounding the anchor rope pin, and at least four threadable guide pins, and further wherein the bottom housing comprises a spring housing with an anchor rope pin seat for receiving the anchor rope pin, and a plate secured to the bottom housing for receiving the at least four threadable guide pins and fasteners to engage a deck of a boat;

a latch assembly mounted to the plate, wherein the latch assembly comprises;

i. a latch bar secured to at least two exterior guide pins, ii. a trip-latch hinge finger adapted to removably engage the latch bar; and iii. a solenoid aligned with the trip-latch hinge finger for striking the trip-latch hinge finger and releasing the latch bar, enabling the spring to move the anchor rope pin away from the anchor rope pin seat, wherein the solenoid is further connected to a power supply;

a receiver disposed within a control box adapted for receiving a signal to energize the solenoid to strike the trip-latch hinge finger;

a remote transmitter for transmitting the signal to the receiver for energizing the solenoid; and a linear actuating device comprising a connection to a plurality of relays contained within the control box for steering a trolling motor when the linear actuating device receives a signal from the control box.

2. The watercraft recovery device of claim 1, wherein the linear actuating device is mounted to the trolling motor frame or mounted to the deck of a boat for pushing or pulling the trolling motor.

3. The watercraft recovery device of claim 1, wherein the remote transmitter has a transmission range from 1 inch to 2500 feet.

4. The watercraft recovery device of claim 1, wherein the anchoring device is made from a non-corrosive material.

5. The watercraft recovery device of claim 1, wherein the anchor pin has a tapered end for engaging the anchor rope pin seat.

6. The watercraft recovery device of claim 1, wherein each exterior guide pin comprises a mechanical stop for controlling a distance of movement between the anchor release device and the bottom plate.

7. The watercraft recovery device of claim 1, wherein the anchor rope has a looped end which is secured to the anchor release device by the anchor rope pin.

8. A method for providing a remote-controlled watercraft comprising the steps of:

a. mounting a watercraft recovery device to a watercraft, wherein the watercraft recovery device comprises:

i. an anchor release device comprising: a top plate connected to a top housing, wherein the top housing comprises a anchor rope pin disposed in the top housing and a trip spring surrounding the anchor rope pin, and wherein the top plate comprises at least four guide pins mounted to the top plate, wherein the guide pins connect the top plate to a bottom plate;

ii. the bottom plate comprising: a bottom housing comprising a bottom side secured to a top side of the bottom plate and a top side overlayed by and slidably engaging the top housing and at least one mounting means attached to a bottom side of the bottom plate, and wherein the bottom housing comprises an anchor rope pin seat disposed on the bottom side of the bottom housing adapted for receiving an anchor rope pin, and wherein the bottom plate has at least four extrusions aligned to receive the at least four guide pins;

iii. a latch assembly mounted to the bottom side of the bottom plate, wherein the latch assembly comprises:

I. a latch bar secured to at least two guide pins,

II. a trip-latch hinge finger adapted to removably engage the latch bar;

III. a solenoid aligned with the trip-latch hinge finger for striking the trip-latch hinge finger and causing the trip-latch hinge finger to disengage the latch bar enabling the trip spring to move the top housing away from the bottom plate;

IV. a power source adapted to provide power to the solenoid;

V. a receiver adapted for receiving a signal transmitted from a remote transmitter to energize the solenoid to strike the trip-latch hinge finger; and VI. a remote transmitter for transmitting a signal to the receiver for energizing the solenoid;

b. connecting a rope to an anchoring device, wherein the rope comprises a first end with a loop and a second end connected to an anchoring mechanism, wherein the rope connects to the anchor release device by using the closed loop;

c. moving the top plate toward the bottom plate forcing the spring to be in a compressed state, causing the anchor rope pin to engage the anchor rope pin seat causing the anchor rope pin to secure the looped first end of the rope for retaining the rope;

d. anchoring a watercraft for a period of time;

e. using a remote transmitter after completion of the period of time, wherein the remote transmitter provides a signal to the receiver to energize the solenoid on the anchoring device;

f. striking the trip-latch hinge finger with the energized solenoid to cause the trip-latch hinge finger to disengage the latch bar enabling the spring to move the top housing away from the bottom plate causing the anchor rope pin to disengage the anchor rope pin seat and release the looped end of the rope;

g. starting the motor by sending a signal from the transmitter activating a motor start relay;

h. steering the watercraft by using the transmitter to activate a plurality of relays connected to a linear actuator which is connected to the motor of a watercraft;

i. boarding the watercraft when it is in a desired location; and j. directing the watercraft to port.

9. The method of claim 8, wherein the remote transmitter is a member selected from the group consisting of: a Directed Electronic three-channel receiver and transmitter, a two-way alert remote-control transmitter and receiver, other electronic transmitter and receiver, and combinations thereof.

10. The method of claim 8, wherein the watercraft is a member selected from the group consisting of: a floating vessel, a floating recreational vessel, and combinations thereof.

11. An anchor release device comprising: a top housing comprising a centrally positioned anchor rope pin for releasably holding an anchor rope, a spring surrounding the anchor rope pin, and a top plate connected to the top of the top housing;

at least four guide pins fixedly connected to the top plate and slidably disposed within at least four extrusions disposed within a bottom plate;

wherein the bottom plate comprises a bottom housing comprising a tubular member adapted to contain the spring within and secured to a top side of the bottom plate;

wherein the bottom housing is slidably overlayed by the top housing, and wherein the bottom housing comprises a centrally aligned pin guide hole disposed above an anchor rope insertion cavity to operatively receive a looped end of an anchor rope, wherein the anchor rope insertion cavity is centrally aligned on the bottom housing;

the bottom plate further comprising at least two mount pin extrusions, wherein at least two mount pins are disposed within the at least two mount pin extrusions such that the at least two mount pins protrude away from the top plate;

a latch assembly mounted to a bottom side of the bottom plate, wherein the latch assembly comprises;

i. a latch bar secured to two of the at least four guide pins;

ii. a trip-latch hinge finger adapted to removably engage the latch bar; and iii. a solenoid aligned with the trip-latch hinge finger for striking the trip-latch hinge finger and releasing the latch bar enabling the trip spring to move the anchor rope pin away from an anchor rope pin seat, wherein the solenoid is further connected to a relay disposed within a control box;

a receiver disposed within the control box adapted for receiving a signal to energize the solenoid causing the solenoid to strike the trip-latch hinge finger; and a remote transmitter for transmitting the signal to the receiver for energizing the solenoid.

12. The anchor release device of claim 11, wherein the anchor rope pin has a tapered end for engaging an anchor rope pin seat formed into a top side of the bottom plate.

13. The anchor release device of claim 11, wherein the anchor release device can be mounted to a watercraft, aircraft, or land craft.

* * * * *